US011448372B2

(12) United States Patent
Wenzel et al.

(10) Patent No.: US 11,448,372 B2
(45) Date of Patent: Sep. 20, 2022

(54) WORK LIGHT

(71) Applicant: MILWAUKEE ELECTRIC TOOL CORPORATION, Brookfield, WI (US)

(72) Inventors: Duane W. Wenzel, Waukesha, WI (US); Brian Cornell, West Allis, WI (US); Alan Amundson, Milwaukee, WI (US); Jun Ma, HuaiAn (CN); Jay J. Rosenbecker, Menomonee Falls, WI (US); Jing Su, LongYan (CN); Jason Isaacs, Milwaukee, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 0 days.

(21) Appl. No.: 17/094,117

(22) Filed: Nov. 10, 2020

(65) Prior Publication Data

US 2021/0156528 A1 May 27, 2021

Related U.S. Application Data

(60) Provisional application No. 62/939,465, filed on Nov. 22, 2019, provisional application No. 62/939,425, filed on Nov. 22, 2019.

(30) Foreign Application Priority Data

Jun. 22, 2020 (CN) ..... 202021172042.0

(51) Int. Cl.
*F21L 4/02* (2006.01)
*F21L 4/04* (2006.01)
(Continued)

(52) U.S. Cl.
CPC ..... *F21L 4/027* (2013.01); *F21L 4/04* (2013.01); *F21L 4/08* (2013.01); *F21V 21/0965* (2013.01);
(Continued)

(58) Field of Classification Search
CPC ..... F21L 4/04; F21L 4/08; F21V 21/0965; F21V 21/08
See application file for complete search history.

(56) References Cited

U.S. PATENT DOCUMENTS 5,871,272 A * 2/1999 Sharrah ..... F21V 31/03 362/184
6,095,661 A 8/2000 Lebens et al.
(Continued)

FOREIGN PATENT DOCUMENTS

CN 1230040 2/1988
CN 101146388 3/2008
(Continued)

OTHER PUBLICATIONS

International Search Report and Written Opinion for Application No. PCT/US2020/059814 dated Mar. 5, 2021 (11 pages).

*Primary Examiner* — William N Harris
(74) *Attorney, Agent, or Firm* — Michael Best & Friedrich LLP

(57) ABSTRACT

A work light includes a body, a light source head, and a battery. The body includes a mount surface for mounting the work light to a structure. The light source head is pivotably connected to the body. The light source head is opposite the mount surface of the body. The battery is removably coupled to the body. The battery includes a support surface. The support surface is disposed outside of the body. The support surface is oriented perpendicular to the mount surface.

12 Claims, 14 Drawing Sheets

(51) Int. Cl.

| | |
|---|---|
| ***F21V 21/30*** | (2006.01) |
| ***F21V 23/00*** | (2015.01) |
| ***F21V 21/096*** | (2006.01) |
| ***F21V 21/40*** | (2006.01) |
| ***F21L 4/08*** | (2006.01) |
| ***F21Y 115/10*** | (2016.01) |

(52) U.S. Cl.
CPC ..... *F21V 21/30* (2013.01); *F21V 21/406* (2013.01); *F21V 23/003* (2013.01); *F21Y 2115/10* (2016.08)

(56) References Cited

U.S. PATENT DOCUMENTS 6,179,431 B1 1/2001 Chien
6,231,370 B1 5/2001 Morin et al.
6,305,818 B1 10/2001 Lebens et al.
6,488,390 B1 12/2002 Lebens et al.
6,573,659 B2 6/2003 Toma et al.
6,808,287 B2 10/2004 Lebens et al.
7,186,000 B2 3/2007 Lebens et al.
7,186,002 B2 3/2007 Matthews et al.
7,196,477 B2 3/2007 Richmond
D541,962 S 5/2007 Bayat et al.
D544,620 S 6/2007 Son
D554,781 S 11/2007 Shiu
7,338,189 B2 * 3/2008 Kovacik ..... F21L 14/023 362/196
7,344,270 B2 3/2008 Kim
7,393,119 B2 7/2008 Lebens et al.
7,429,827 B2 9/2008 Richmond
7,517,107 B2 4/2009 Dallas et al.
7,740,371 B1 6/2010 Lebens et al.
7,850,330 B2 12/2010 Spartano et al.
7,888,883 B2 2/2011 Crawford et al.
7,942,553 B2 5/2011 Huang
7,959,317 B2 6/2011 Spartano et al.
8,063,607 B2 11/2011 Crawford et al.
8,104,915 B1 1/2012 Osterhout et al.
8,115,492 B2 2/2012 Crawford et al.
8,120,268 B2 2/2012 Spartano et al.
8,134,300 B2 3/2012 Maglica et al.
8,159,146 B1 4/2012 Lebens et al.
8,197,085 B2 6/2012 Spartano
8,324,836 B2 12/2012 Crawford et al.
8,362,700 B2 1/2013 Richmond
8,362,712 B1 1/2013 Lebens et al.
8,414,142 B2 4/2013 Tucker et al.
8,628,210 B2 1/2014 Tucker et al.
8,643,305 B2 2/2014 Lebens et al.
8,717,034 B2 5/2014 Crawford et al.
8,727,561 B2 5/2014 Sharrah et al.
D708,376 S 7/2014 Crowe et al.
8,779,683 B2 7/2014 Snyder et al.
8,810,191 B2 8/2014 Maldonado
D713,076 S 9/2014 von Waldthausen
8,829,808 B1 9/2014 Lebens et al.
8,853,951 B2 10/2014 Garcia
8,866,392 B2 10/2014 Chen
D721,841 S 1/2015 Kwon et al.
8,975,822 B2 3/2015 Maglica et al.
D731,687 S 6/2015 Haws
9,101,022 B2 8/2015 Hoffman et al.
9,119,266 B1 8/2015 Lebens et al.
D739,063 S 9/2015 Su
D742,568 S 11/2015 Abernethy
9,179,520 B2 11/2015 Trattler
9,252,613 B2 2/2016 Kugel et al.
D757,318 S 5/2016 Evans
D764,087 S 8/2016 Workman et al.
D766,477 S 9/2016 Ma
9,447,951 B2 9/2016 Maglica et al.
9,549,454 B2 1/2017 Maglica et al.
9,801,256 B2 10/2017 Maglica et al.
D805,666 S 12/2017 Nguyen et al.
D806,923 S 1/2018 Koshiba
D810,335 S 2/2018 Levy et al.
D819,245 S 5/2018 Gerza
D821,007 S 6/2018 Chen
D831,248 S 10/2018 Kuhls
D854,207 S 7/2019 Zheng
D855,228 S 7/2019 Cooper et al.
D857,958 S 8/2019 Willows et al.
D858,830 S 9/2019 Grandadam
D858,831 S 9/2019 Proeber
D858,833 S 9/2019 Cooper
D858,837 S 9/2019 Vazquez et al.
D861,209 S 9/2019 Cooper
11,035,556 B2 * 6/2021 Proeber ..... F21V 23/0414
11,098,858 B2 * 8/2021 Westling ..... F21L 4/045
2003/0076051 A1 4/2003 Bowman et al.
2003/0234778 A1 12/2003 Kim
2006/0043911 A1 3/2006 Shao et al.
2006/0072306 A1 4/2006 Woodyard
2006/0109662 A1 5/2006 Reiff et al.
2007/0014103 A1 * 1/2007 Teng ..... F21V 21/08 362/157
2008/0225518 A1 * 9/2008 Devaney ..... F21L 4/04 362/197
2008/0258642 A1 10/2008 Patel
2008/0304254 A1 * 12/2008 Canino ..... F21L 13/06 362/183
2009/0085502 A1 4/2009 Geris et al.
2010/0084997 A1 4/2010 Oberzeir et al.
2012/0033412 A1 2/2012 Molina et al.
2012/0033415 A1 * 2/2012 Sharrah ..... F21V 21/08 362/199
2012/0182723 A1 7/2012 Sharrah et al.
2012/0182727 A1 * 7/2012 Sharrah ..... F21V 21/0885 362/190
2012/0182748 A1 7/2012 McCaslin et al.
2012/0286940 A1 11/2012 Carmen, Jr. et al.
2013/0258649 A1 * 10/2013 Mueckl ..... F21V 17/12 362/191
2014/0085876 A1 * 3/2014 Fields ..... F21L 14/023 362/187
2014/0126192 A1 * 5/2014 Ancona ..... F21V 21/0885 362/191
2015/0131276 A1 5/2015 Thompson et al.
2015/0247628 A1 * 9/2015 Li ..... F21L 4/005 362/183
2015/0267902 A1 9/2015 Zhang
2016/0061429 A1 * 3/2016 Waalkes ..... H01R 25/142 362/217.15
2016/0128151 A1 5/2016 Luick et al.
2016/0265754 A1 9/2016 Sun
2016/0356439 A1 * 12/2016 Inskeep ..... F21L 4/027
2017/0284646 A1 10/2017 Arena et al.
2017/0292659 A1 * 10/2017 Bayat ..... F21V 23/0428
2018/0027627 A1 1/2018 Maglica et al.
2018/0034313 A1 2/2018 Frankland et al.
2018/0156427 A1 6/2018 Bailey et al.
2018/0224077 A1 * 8/2018 Bian ..... F21L 4/04
2018/0266637 A1 9/2018 Curlett et al.
2019/0331326 A1 * 10/2019 Proeber ..... F21V 21/0885
2020/0340634 A1 * 10/2020 Puzio ..... F21V 15/01

FOREIGN PATENT DOCUMENTS

CN 201360368 12/2009
CN 203942676 11/2014
EP 2827684 1/2015
KR 2020160002590 U 7/2016

* cited by examiner

WORK LIGHT

TECHNICAL FIELD

The present disclosure relates to a work light, and more particularly to a battery-powered work light.

BACKGROUND

Work lights can be used to illuminate work areas that are otherwise difficult to light. Examples of these areas include work sites, ceiling spaces, basement areas, and the like.

SUMMARY

The disclosure provides, in a first aspect, a work light. The work light includes a body, a light source head, and a battery. The body includes a mount surface for mounting the work light to a structure. The light source head is pivotably connected to the body. The light source head is opposite the mount surface of the body. The battery is removably coupled to the body. The battery includes a support surface. The support surface is disposed outside of the body. The support surface is oriented perpendicular to the mount surface.

In one embodiment of the first aspect, the light source head is pivotably connected to the body by a single hinge.

In one embodiment of the first aspect, a portion of the battery is received inside the body.

In one embodiment of the first aspect, the work light further comprises a power button disposed on an end of the body opposite the battery.

In one embodiment of the first aspect, the light source head includes a planar light panel, and the planar light panel is orientable perpendicular to the support surface of the battery.

In one embodiment of the first aspect, the body includes a cross-sectional shape that is an isosceles triangle with rounded corners.

The disclosure also provides, in a second aspect, a work light. The work light includes a body, a light source head, and a battery. The body includes a first end, a second end, a first grip section, and a second grip section. The second end is opposite the first end. The second end includes a battery receptacle defined in the body. The first grip section is disposed on one side of the body between the first end and the second end. The second grip section is disposed on another side of the body between the first end and the second end. The second grip section is opposite the first grip section. The light source head is coupled to the body between the first end and the second end. The light source head includes a planar light panel. The battery includes a connection portion and an external portion. The connection portion is disposed in the battery receptacle of the body. The external portion is disposed outside of the body.

In one embodiment of the second aspect, the work light further comprises a charging port coupled to the body adjacent the first end of the body, and a charging port cover pivotably connected to the body.

In one embodiment of the second aspect, each of the first grip section and the second grip section includes an indentation defined in the body.

In one embodiment of the second aspect, the body includes a continuous indentation defined therein. The continuous indentation extends about a majority of a perimeter of the body. The first grip section and the second grip section are disposed in the continuous indentation.

In one embodiment of the second aspect, the light source head pivots relative to the body about a pivot axis, and a length direction of the battery receptacle is parallel with the pivot axis of the light source head.

In one embodiment of the second aspect, the first grip section and the second grip section are spaced apart along a width dimension of the body, and the body is less than 10 centimeters wide.

In one embodiment of the second aspect, the work light further comprises at least one control switch disposed on the body adjacent the first end.

The disclosure further provides, in a third aspect, a work light. The work light includes a body and a light source. The body includes a mount surface, a pair of ferromagnetic members, and a recess. The pair of ferromagnetic members is coupled to the body. The pair of ferromagnetic members is disposed adjacent the mount surface. A space is defined between the pair of ferromagnetic members. The recess is defined in the mount surface in the space between the ferromagnetic members. The recess receives a projection from which the work light can be hung. The light source is coupled to the body opposite the mount surface.

In one embodiment of the third aspect, each of the pair of ferromagnetic members includes a permanent magnet.

In one embodiment of the third aspect, the work light further comprises a permanent magnet disposed within the body of the work light, the permanent magnet magnetizing each of the pair of ferromagnetic members.

In one embodiment of the third aspect, each of the pair of ferromagnetic members is at least partially exposed on the mount surface of the body.

In one embodiment of the third aspect, each of the pair of ferromagnetic members includes a length that extends in a direction that is parallel with a length of the body.

In one embodiment of the third aspect, the mount surface includes an indentation. The pair of ferromagnetic members are disposed in the indentation. The recess is disposed in the indentation.

In one embodiment of the third aspect, the body is narrower adjacent the light source than adjacent the mount surface.

Other features and aspects of the disclosure will become apparent by consideration of the following detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting.

Figure 1:
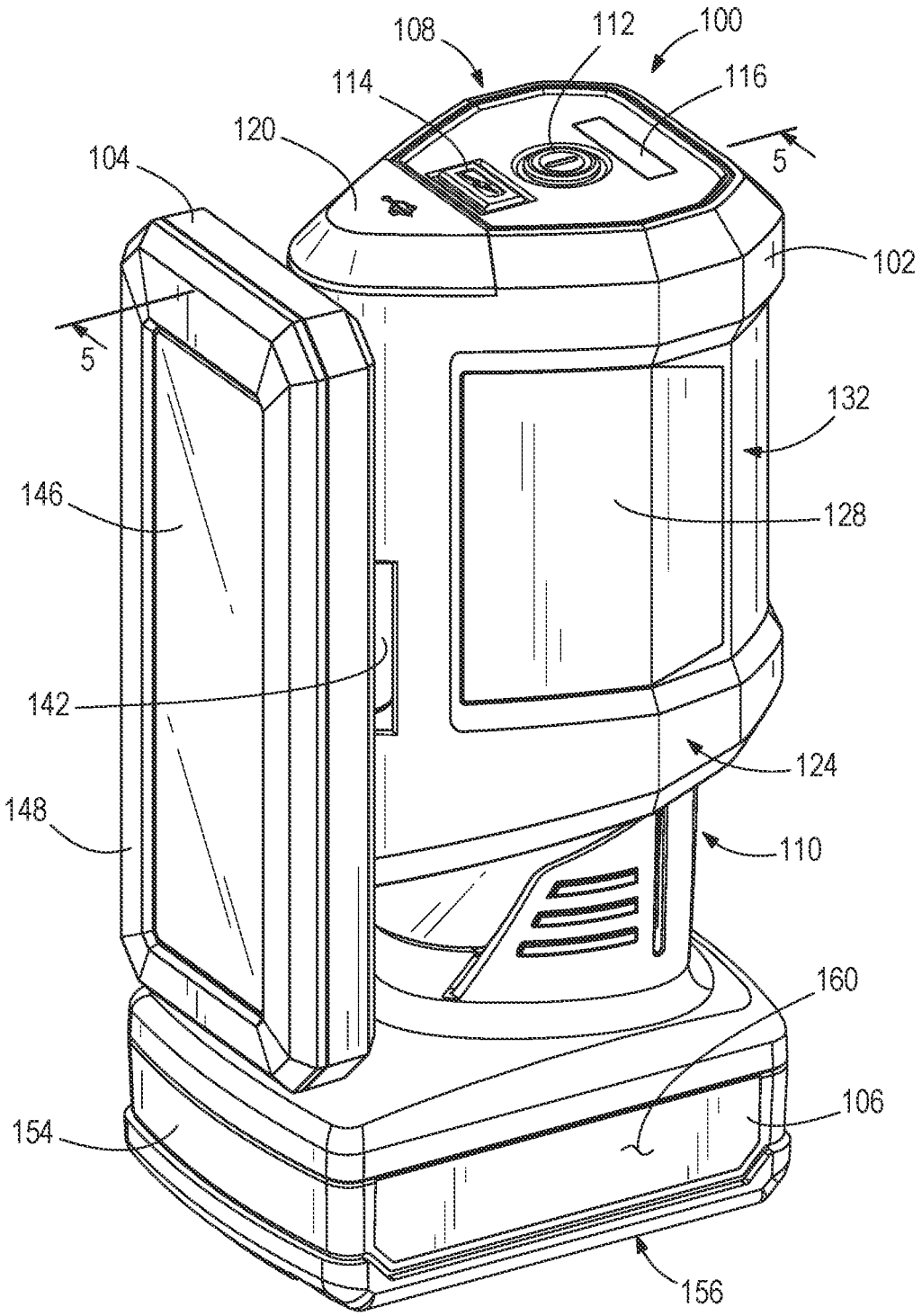
FIG. 1 is a front perspective view of a work light according to an embodiment of the disclosure.

FIG. 1 illustrates a work light 100 according to an embodiment of the present disclosure. The illustrated work light 100 is battery-powered. The work light 100 is sized and shaped for one-handed operation and transport. The work light 100 includes a body 102 and a light source head 104 coupled to the body 102. A battery 106 is also removably coupled to the body 102.

The body 102 includes a first end 108 and a second end 110 opposite the first end 108. In the illustrated embodiment, the first end 108 includes one or more controls, such as a power button 112 and a wake button 114, disposed thereon. The illustrated embodiment further includes one or more indicators, such as one or more battery power gauge lights 116, disposed on the first end 108 of the body 102.

Figure 2:
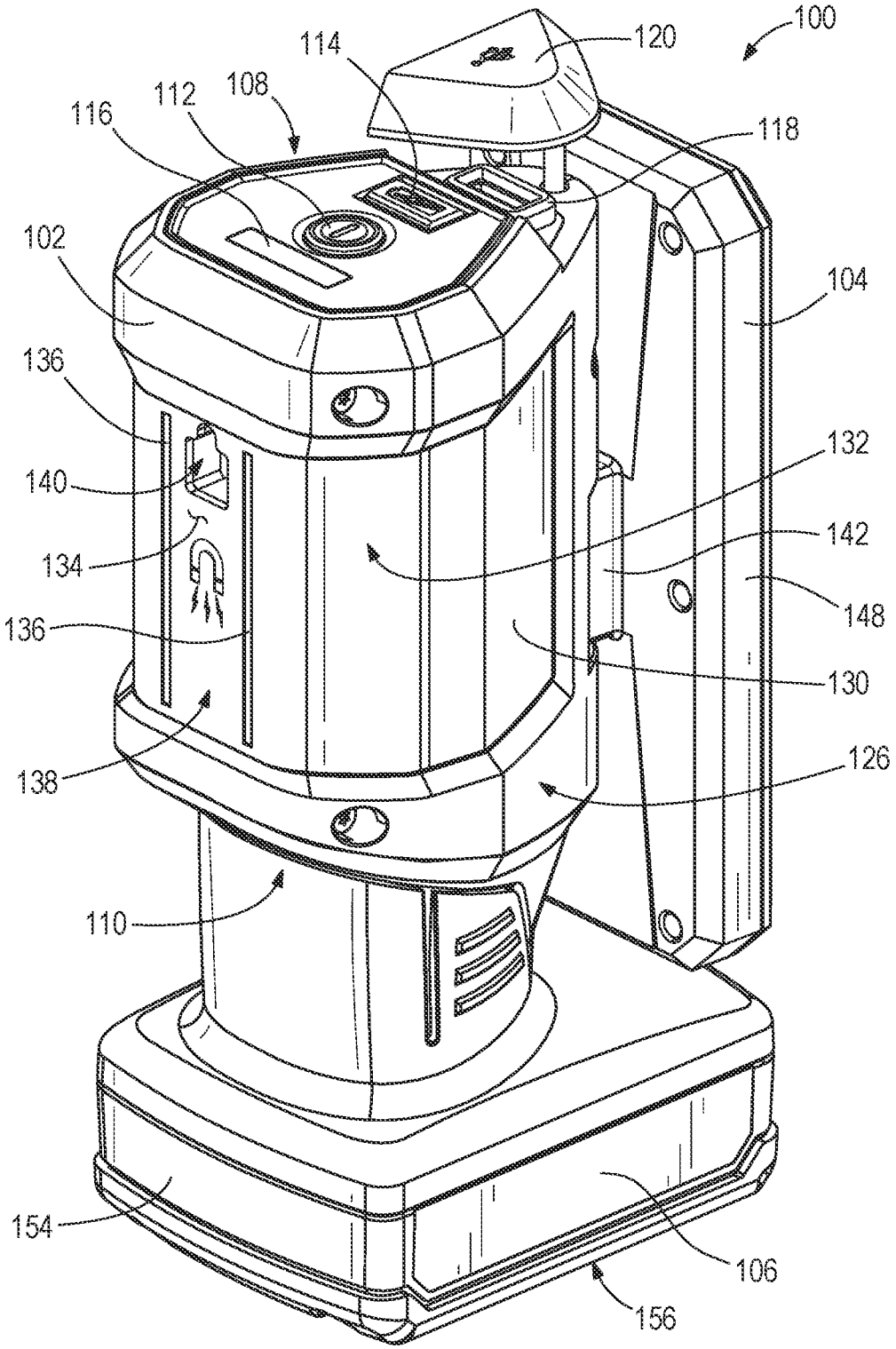
FIG. 2 is a rear perspective view of the work light of FIG. 1.

As shown in FIG. 2 of the illustrated embodiment, the body 102 further includes a charging port 118 disposed on the first end 108 of the body 102. In the illustrated embodiment, the charging port 118 is a USB port. The charging port 118 is selectively covered with a charging port cover 120 pivotably connected to the body 102. In the illustrated embodiment, the charging port cover 120 pivots and raises relative to the first end 108 of the body 102, while remaining connected to the body 102, to selectively uncover the charging port 118. In other embodiments, other suitable covers may be used. The charging port may 118 may be utilized to charge a device, such as a user's cell phone. Additionally or alternatively, the charging port 118 may be used as a power input port to charge the battery 106 without the need for removing the battery 106. Additionally or alternatively, the charging port 118 may be used as a power input port to bypass the battery 106 and power the work light 100 with an outside power source, such as mains power. The wake button 114 discussed above may be engaged by a user in order to activate the charging port 118 for energy output to charge and/or power an external device.

Of course, some or all of the controls, indicators, and the charging port 118 may instead be disposed on other portions of the work light 100 or may be omitted entirely.

Figure 5:
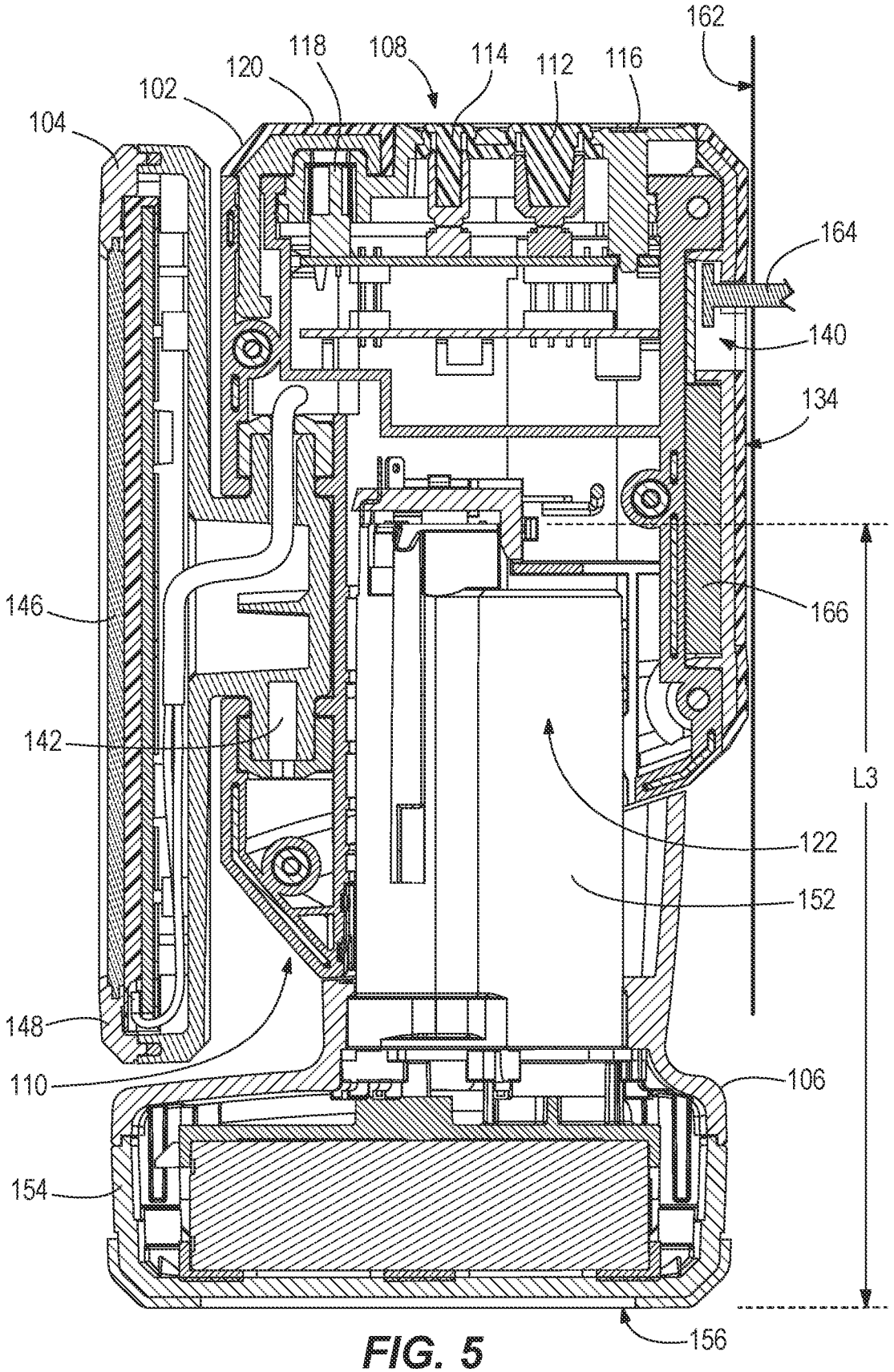
FIG. 5 is a cross-sectional side elevation view of the work light of FIG. 1 coupled to a structure.
Figure 6:
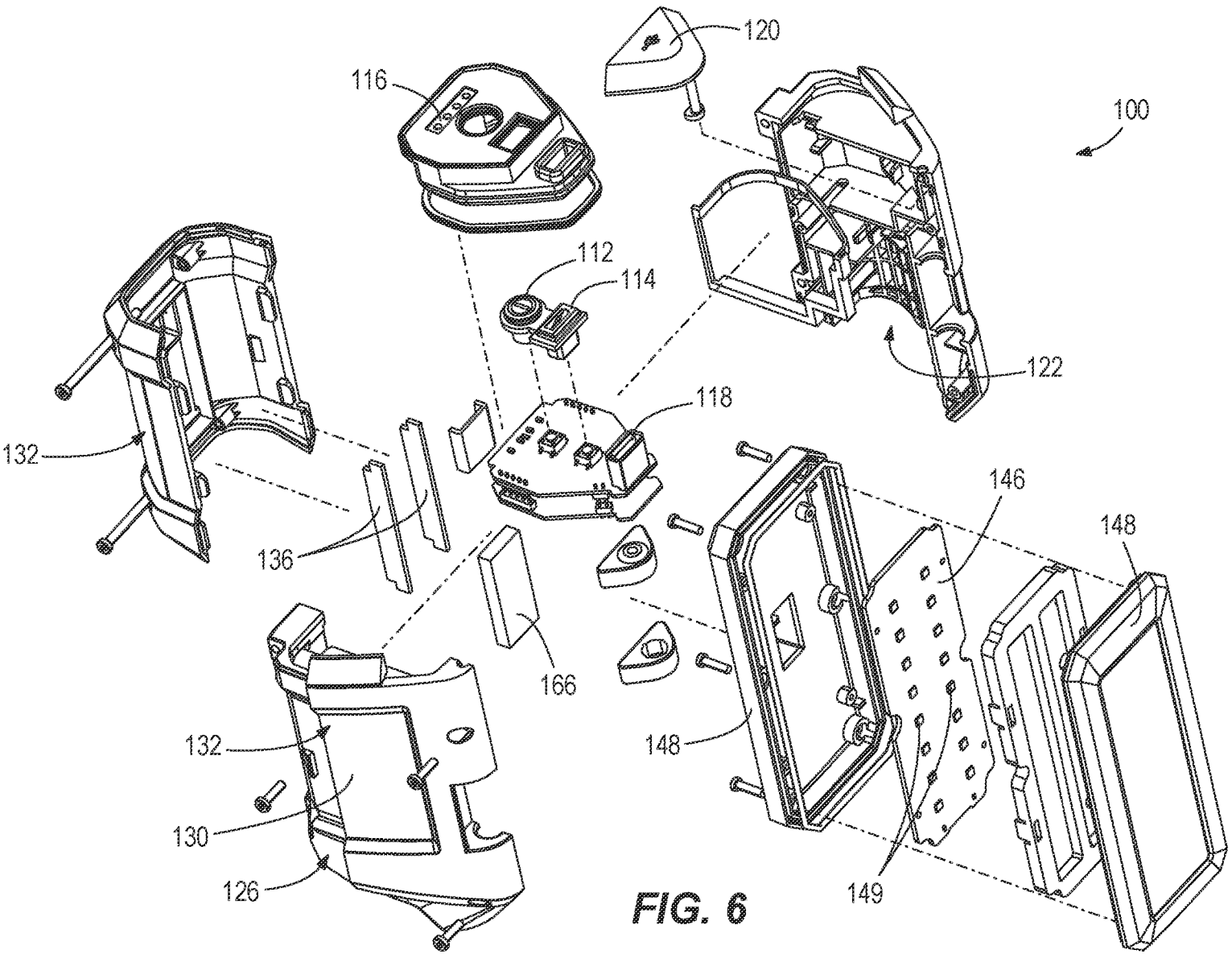
FIG. 6 is an exploded view of the work light of FIG. 1.

Shown best in FIGS. 5 and 6, the body 102 of the work light 100 further includes a battery receptacle 122 defined in the second end 110. The battery receptacle 122 receives at least a portion of the battery 106 to power the work light 100 (discussed in more detail below).

Returning to FIGS. 1 and 2, the body 102 of the work light 100 also includes two opposing sides 124, 126 extending between the first end 108 and the second end 110 of the body 102. Each side 124, 126 includes a grip section 128, 130 disposed thereon. In some embodiments, each of the first grip section 128 and the second grip section 130 includes at least part of an indentation defined in the body 102. As shown in the illustrated embodiment, a continuous indentation 132 is defined in the body 102 such that the indentation 132 extends about a majority of a perimeter of the body 102. The perimeter is defined by the outer surfaces of the body 102 located between the first end 108 and the second end 110. In this illustrated embodiment, each of the first grip section 128 and the second grip section 130 is disposed in the indentation 132. The first and second grip sections 128, 130 may be only the respective portions of the indentation 132 itself, or the grip sections 128, 130 may further include a textured surface or additional material disposed in the indentation 132 to further facilitate a secure grip of the work light 100.

With reference to FIG. 2, the body 102 further includes a mount surface 134. The mount surface 134 is disposed between the two opposing sides 124, 126, opposite from the light source head 104. The mount surface 134 allows a user to mount the work light 100 to one or more structures. In the illustrated embodiment, the body 102 includes a pair of ferromagnetic members 136 coupled thereto and disposed adjacent the mount surface 134. In some embodiments, such as the illustrated embodiment, at least a portion of each of the pair of ferromagnetic members 136 is exposed on the mount surface 134. In other embodiments, however, the ferromagnetic members 136 may be completely disposed within and concealed by the body 102. The ferromagnetic members 136 are separated from each other by a space 138. In the illustrated embodiment, each of the ferromagnetic members 136 includes a length that extends in a direction that is parallel with the length L1 of the body 102 (shown in FIG. 3). Also in the illustrated embodiment, both of the ferromagnetic members 136 are disposed in the continuous indentation 132. In this embodiment, the ferromagnetic members 136 extend outward beyond the surface of the indentation 132 so as to directly engage a surface of a structure. Of course, other embodiments may include ferromagnetic member 136 that may not directly engage a surface of a structure so as to avoid scratching the surface. Such embodiments may include the ferromagnetic members 136 being flush with the surface of the indentation 132 or recessed relative to the surface of the indentation 132.

As shown in FIG. 2, a recess 140 is defined in the mount surface 134. The recess 140 is located between the ferromagnetic members 136. Stated another way, the recess 140 is located in the space 138. In the illustrated embodiment, the recess 140 is also located in the continuous indentation 132. The recess 140 may be any appropriate shape and size, but is illustrated as a keyhole slot.

Figure 3:
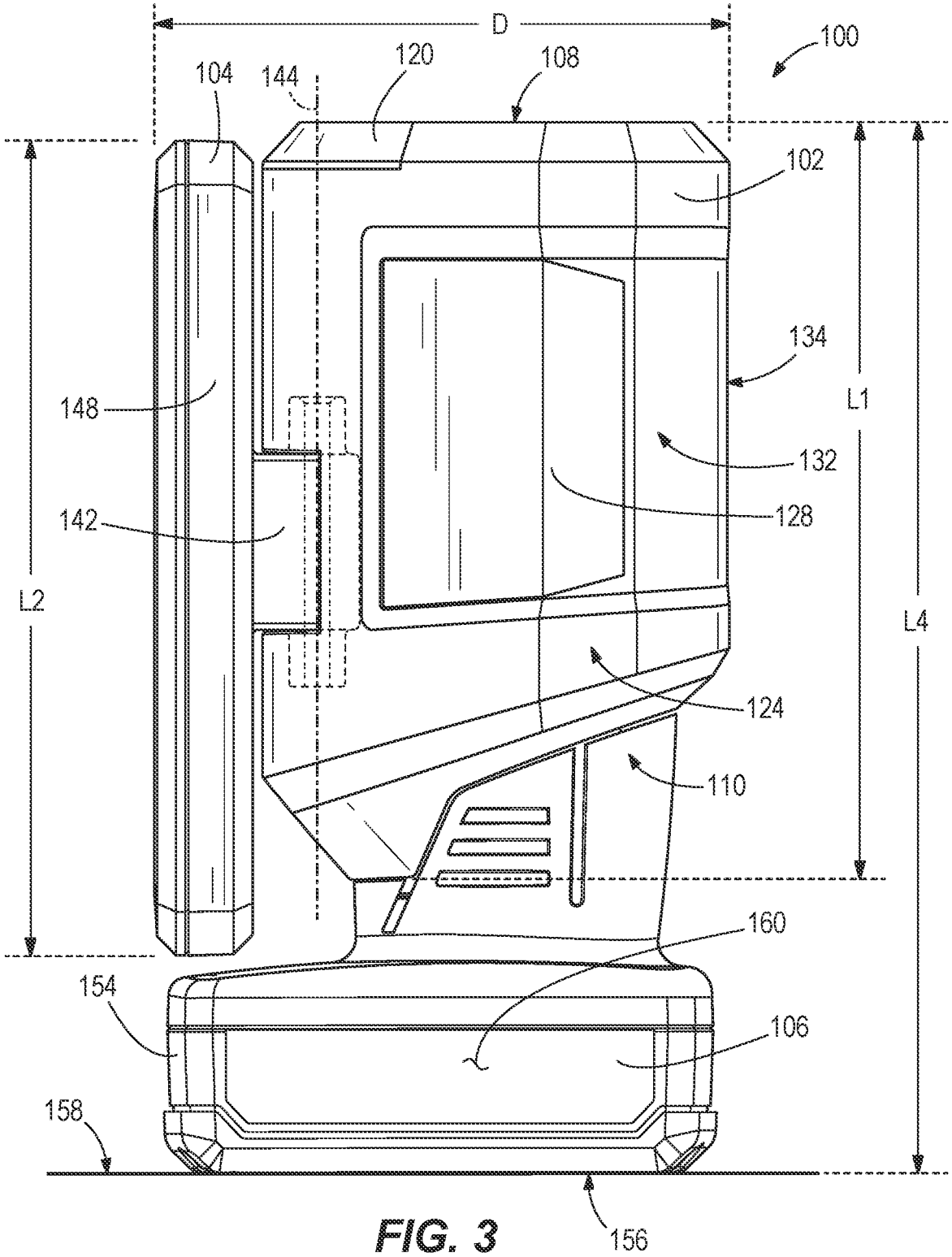
FIG. 3 is a side elevation view of the work light of FIG. 1.

With reference to FIG. 3, the light source head 104 is pivotably connected to the body 102. In the illustrated embodiment, the light source head 104 is coupled to the body 102 opposite the mount surface 134 of the body 102. As shown in FIG. 3, the light source head 104 is coupled to the body 102 by a hinge 142. In the illustrated embodiment, the light source head 104 is coupled to the body 102 by a single hinge 142 located between the first end 108 and the second end 110 of the body 102, although other embodiments may include different or additional pivotable connections between the light source head 104 and the body 102. The light source head 104 is pivotable relative to the body 102 about a pivot axis 144. In the illustrated embodiment, the pivot axis 144 extends in a direction that is parallel to the length L1 of the body 102. The light source head 104 includes a planar light panel 146 (FIG. 1) surrounded by a head frame 148 to mitigate damage to the light panel 146 from dropping the work light 100. The illustrated embodiment includes the planar light panel 146 recessed relative to the head frame 148. The light panel 146, and the light source head 104 itself, may be any size, but the illustrated embodiment includes a light panel 146 that extends along a majority of the length L1 of the body 102 of the work light 100. Further, the light panel 146 includes a plurality of light-emitting diodes (LEDs) 149, but other embodiments may include additional or alternative light sources. As shown in FIG. 6, the LEDs 149 are arranged in two parallel columns. In other embodiments, the LEDs 149 may be arranged in other configurations.

The light panel 146 may be operable in different modes, such as a HIGH mode and a LOW mode. In some embodiments, the light panel 146 may produce light having a brightness of 700 Lumens or more in the HIGH mode and a brightness of 300 Lumens or less on in the LOW mode. The work light 100 is operable to switch modes by actuating the power button 112. More specifically, the light panel 146 may produce light having a brightness of 750 lumens while in the HIGH mode and a brightness of 250 Lumens while in the LOW mode. In other embodiments, the light panel 146 may be operable in different modes and/or may be switchable between the modes by a dedicated actuator.

The light panel 146 is selectively powered by the battery 106. The illustrated battery 106 is a power tool battery having a voltage of, for example, 12 volts. The battery 106 also has a Li-ion chemistry. In other embodiments, the battery 106 may have other voltages and chemistries. The illustrated battery 106 also has a capacity of 4.0 Amp-hours (Ah). With such a battery, the light panel 146 may be powered for at least five hours while in HIGH mode and for at least ten hours while in LOW mode. In some embodiments, the light panel 146 may be powered for five to eight hours while in HIGH mode and may be powered for ten to sixteen hours while in LOW mode. In further embodiments, the light panel 146 may be powered for longer in either mode, depending on the capacity of the battery 106.

Figure 4:
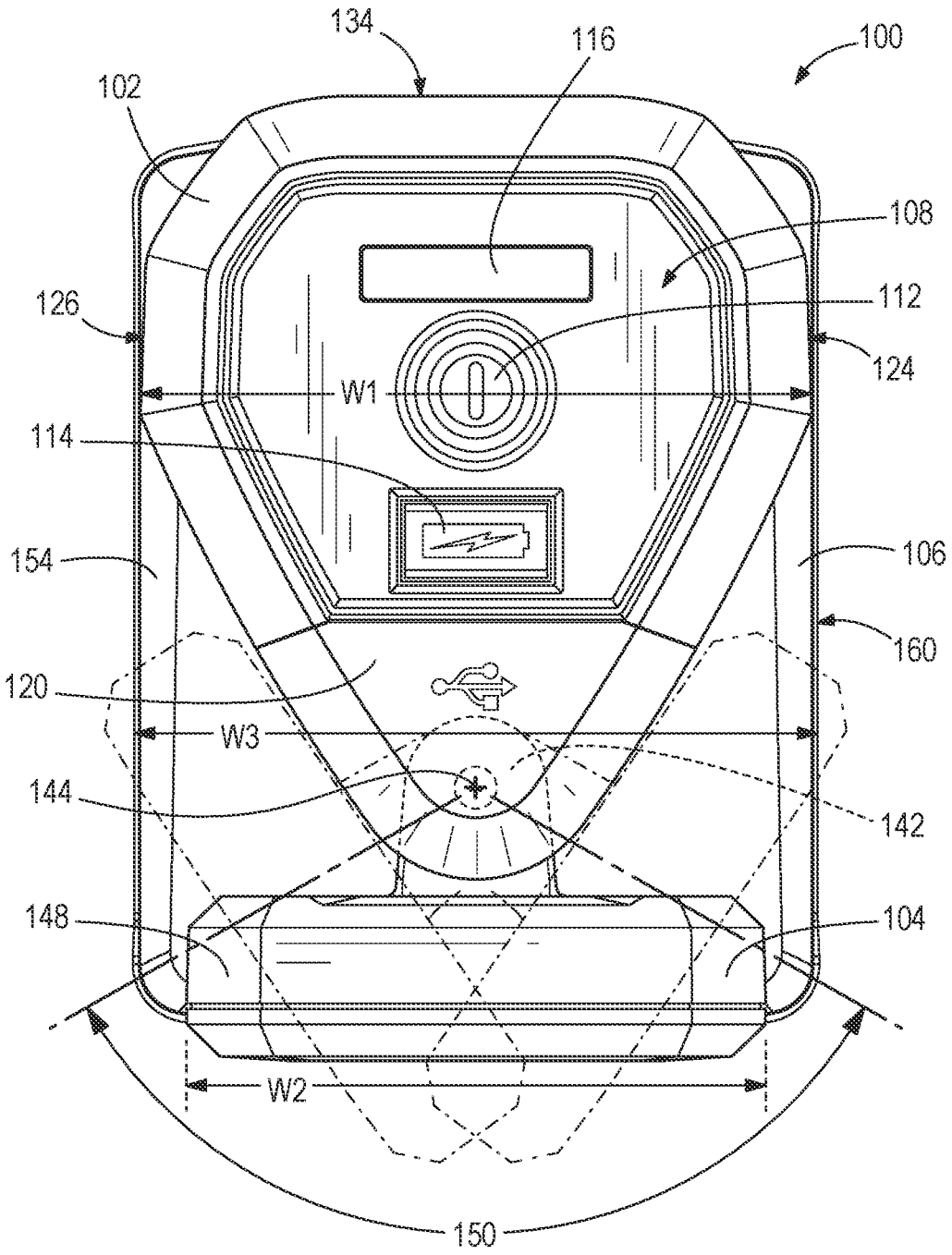
FIG. 4 is a top plan view of the work light of FIG. 1.

As shown in FIG. 4, the light source head 104 may pivot relative to the body 102 along an angle of rotation 150. In some embodiments, the angle of rotation 150 is up to and including 120 degrees. In other embodiments, the angle of rotation 150 is up to and including 180 degrees. In the illustrated embodiment, these angles of rotation 150 are possible due to the shape of the body 102. The body 102 of the illustrated embodiment is narrower adjacent the light source head 104 than it is adjacent the mount surface 134. This configuration of the body 102 allows for a sufficiently wide mount surface 134 while providing clearance for the rotation of the light source head 104. Stated another way, the illustrated embodiment includes a body 102 having horizontal cross-sectional shape that is generally an isosceles triangle with rounded corners. This shape can be seen in FIG. 4.

With reference to FIG. 5, the battery 106 includes a connection portion 152 that is removably received within the battery receptacle 122 of the body 102. The battery 106 further includes an external portion 154 that is disposed outside of the body 102 even when the battery 106 is properly coupled to the body 102. The connection portion 152 of the battery 106 is slidably received in the battery receptacle 122 of the body 102 in a direction parallel to the length L1 of the body 102 in the illustrated embodiment. The length direction of the battery receptacle 122 is parallel with the length L1 of the body 102 and parallel with the pivot axis 144 (FIG. 3) of the light source head 104. In some embodiments, the length of the battery receptacle 122 and the corresponding length of the connection portion 152 of the battery 106 are each longer than one third of the length L1 of the body 102. In some embodiments, the length of the battery receptacle 122 and the corresponding length of the connection portion 152 of the battery 106 are each longer than one half of the length L1 of the body 102.

As shown in FIG. 3, the battery 106 further includes at least one support surface, such as a first support surface 156. This first support surface 156 allows the work light 100 to be oriented and maintained in a vertical standing position on a work surface, such as a horizontal work surface 158 (e.g., a table, a workbench, the ground, etc.). The first support surface 156 is disposed on the external portion 154 of the battery 106 and is perpendicular to the mount surface 134 of the body 102. While the work light 100 is in the vertical standing position, a user may adjust the light source head 104 relative to the body 102 to alter the direction of the light emitted from the light source head 104 to the left or right relative to the horizontal work surface 158. In some embodiments, the first support surface 156 of the battery 106 is perpendicular to the pivot axis 144 of the light source head 104. In some embodiments, the first support surface 156 of the battery 106 is perpendicular to the planar light panel 146.

Figure 7:
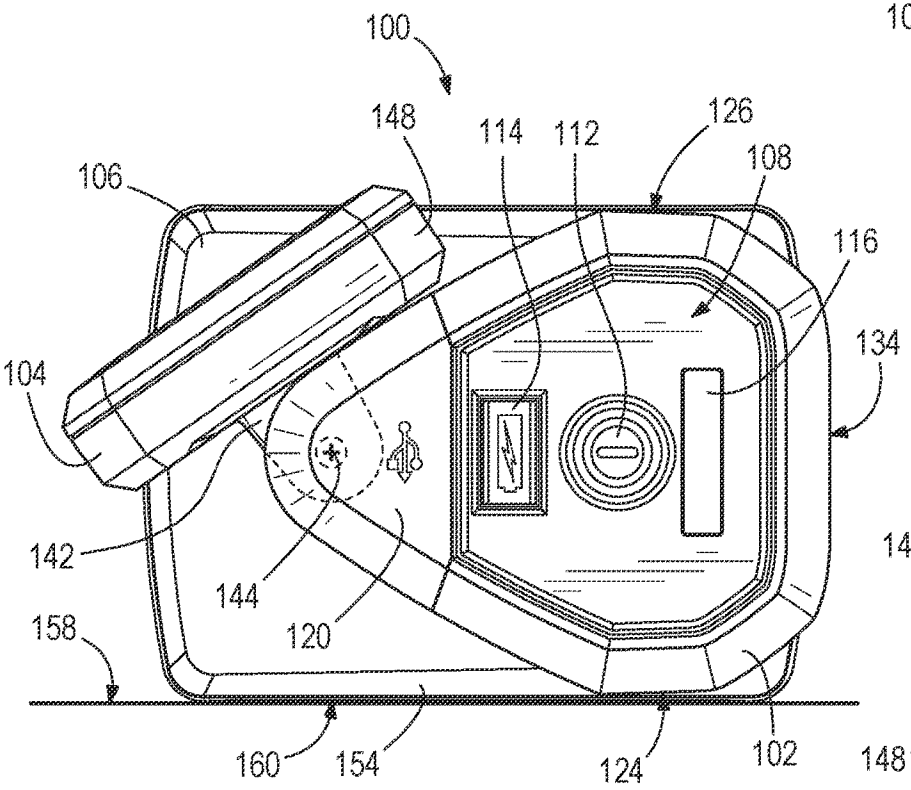
FIG. 7 is a top elevation view of the work light of FIG. 1 laid on its side.

As shown in FIG. 7, the battery 106 may also include at least one additional support surface, such as a second support surface 160. The second support surface 160 is illustrated as being perpendicular to the first support surface 156. This second support surface 160 allows the work light 100 to be oriented and maintained in a horizontal laying position on a work surface, such as the horizontal work surface 158. While the work light 100 is in the horizontal laying position, a user may adjust the light source head 104 relative to the body 102 to alter the direction of the light emitted from the light source head 104 up or down relative to the horizontal work surface 158. In some embodiments, the second support surface 160 of the battery 106 is parallel to the pivot axis 144 of the light source head 104. In some embodiments, the second support surface 160 is perpendicular to the planar light panel 146.

Returning to FIG. 5, the work light 100 is shown mounted to a work surface, such as a vertical work surface 162 (e.g., a wall, strut, cabinet, etc.). In situations where the vertical work surface 162 is made of a material that is not magnetic (such as wood) or is very weakly magnetic, the ferromagnetic members 136 may not work at all or may be insufficient to mount the work light 100 to the vertical work surface 162. In such instances, a user may instead hang the work light 100 by a projection disposed on the vertical work surface 162, such as the nail 164 shown in FIG. 5. The head of the nail 164 is removably received in the recess 140 defined in the mount surface 134 of the body 102. The recess 140 slidably traps the head of the nail 164 such that a user must raise the work light 100 relative to the nail 164 in a direction along the vertical work surface 162 in order to remove the work light 100 from the nail 164.

With reference to FIG. 6, the illustrated embodiment of the work light 100 further includes at least one permanent magnet 166. The permanent magnet 166 is illustrated as being housed within the body 102 of the work light 100 and as being in contact with both of the ferromagnetic members 136. In this illustrated embodiment, each of the ferromagnetic members 136 is magnetized by the permanent magnet 166. The ferromagnetic member 136 may be made of steel, iron, or the like. In other embodiments, however, each of the ferromagnetic members 136 may itself be a permanent magnet. In such embodiments, the additional permanent magnet 166 shown in FIG. 6 may be omitted. In still other embodiments, one or more electromagnets may be included instead of or in addition to one or more permanent magnets.

Figure 8:
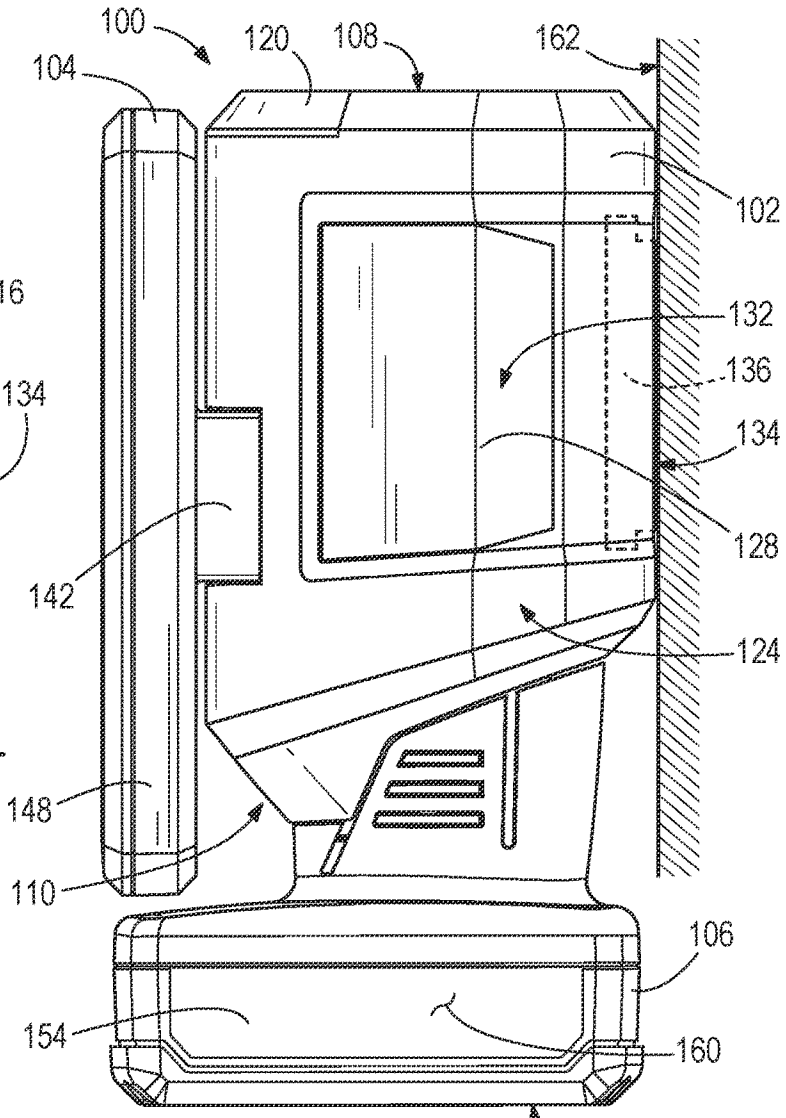
FIG. 8 is a side elevation view of the work light of FIG. 1 coupled to a structure.

As shown in FIG. 8, due to the presence of the ferromagnetic members 136 in the illustrated embodiment, the work light 100 may also be mounted to a vertical work surface 162 without the need for a nail 164 or other projection when the vertical work surface 162 is sufficiently magnetic (such as a structure made at least in part of steel, iron, or the like). In some situations, a user may elect to affix a magnet to a non-magnetic vertical work surface 162 with, for instance, adhesive. In such situations, the ferromagnetic members 136 may magnetically engage the magnet that has been affixed to the vertical work surface 162 to support the work light 100 from the vertical work surface 162 even if the vertical work surface 162 is itself not sufficiently magnetic (such as a vertical work surface 162 made of wood).

As briefly discussed above, the illustrated embodiment of the work light 100 may be sized and shaped for single-handed operation and transport. Further, the work light 100 may be sized and shaped to fit in, for instance, a user's pocket. With reference to FIG. 4, some embodiments of the work light 100 include the body 102 having a width W1 of less than ten centimeters. The width dimension of the body 102 of the work light 100 is perpendicular to the pivot axis 144 of the light source head 104 in the illustrated embodiment. In some embodiments, the width W1 of the body 102 is less than seven centimeters. With reference to FIG. 3, in some embodiments, the length L1 of the body 102 (measured in a direction that is parallel with the pivot axis 144 of the light source head 104 in the illustrated embodiment) is less than fifteen centimeters. In some embodiments, the length L1 of the body 102 is less than ten centimeters. In some embodiments, the distance D between the mount surface 134 of the body and the illuminating face of the planar light panel 146 is less than twelve centimeters. In some embodiments, the distance D between the mount surface 134 and the illuminating face of the planar light panel 146 is less than ten centimeters.

With reference to FIG. 4, some embodiments include the light source head 104 having a width W2 that is slightly less than the width W1 of the body 102. Some embodiments also include the battery 106 having a width W3 that is slightly greater than the width W1 of the body 102. In some embodiments, the width W3 of the battery 106 is between about 1.5 inches and about 3.5 inches (between about 3.8 centimeters and about 8.9 centimeters). In other embodiments, the width W3 of the battery 106 is between about 2.0 inches and about 3.0 inches (between about 5.1 centimeters and about 7.6 centimeters). In some embodiments, the width W2 of the light source head 104 is at least 50% of the width W3 of the battery 106. In other embodiments, the width W2 of the light source head 104 is between about 70% and about 90% of the width W3 of the battery 106.

Referring to FIGS. 3 and 5, the body 102 has a length L1, and the light source head 104 has a length L2 that is longer than the length L1 of the body 102. In some embodiments, the length L2 of the light source head 104 is between about 1.1 times and about 2 times the length L3 of the battery 106. In other embodiments, the length L2 of the light source head 104 is between about 1.1 times and about 1.5 times the length L3 of the battery 106. In some embodiments, the length L1 of the body 102 is between about 1.05 times and about 1.5 times the length L3 of the battery 106. In some embodiments, the length L3 of the battery 106 may be between about 3 inches and about 6 inches (between about 7.6 centimeters and about 15.2 centimeters). In some embodiments, the length L3 of the battery 106 may be about 4.5 inches (about 11.4 centimeters). When the battery 106 is fully inserted into the battery receptacle 122, the work light 100 has a total length L4. In some embodiments, the length L2 of the light source head 104 is between about 50% and about 90% of the total length L4 of the work light 100. In other embodiments, the length L2 of the light source head 104 is between about 75% and about 85% of the total length L4 of the work light 100.

Although various sizes and shapes of batteries may be removably coupled to the body 102 of the work light 100, only a single embodiment of a battery 106 has been shown. Other batteries may be smaller or larger than the battery 106 shown, and these other batteries may also have different shapes from the battery 106 shown. These other batteries may or may not be useful for providing one or more support surfaces to stand the work light 100 or lay the work light 100 in one or more positions. In the illustrated embodiment, the battery 106 is a typical power tool battery that may also be used with, for instance, an electric drill. Of course, other batteries not suitable for power tools may also be used in other embodiments. In some embodiments, the total length L4 of the work light 100, including the battery 106, may be less than fifteen centimeters.

In some embodiments, the work light 100 may also be relatively light and easy to carry by hand. In some embodiments, the work light 100 (including the battery 106) may have a mass that is less than 500 grams. In some embodiments, the work light 100 (including the battery 106) may have a mass that is less than 400 grams. In some embodiments, the work light 100 (including the battery 106) may have a mass that is less than 350 grams.

Although not shown in the illustrated embodiment, some embodiments may include a hook or other hanging structure such that the work light 100 may be hung over the top of a structure, such as a horizontally oriented frame member or the like.

Figure 9:
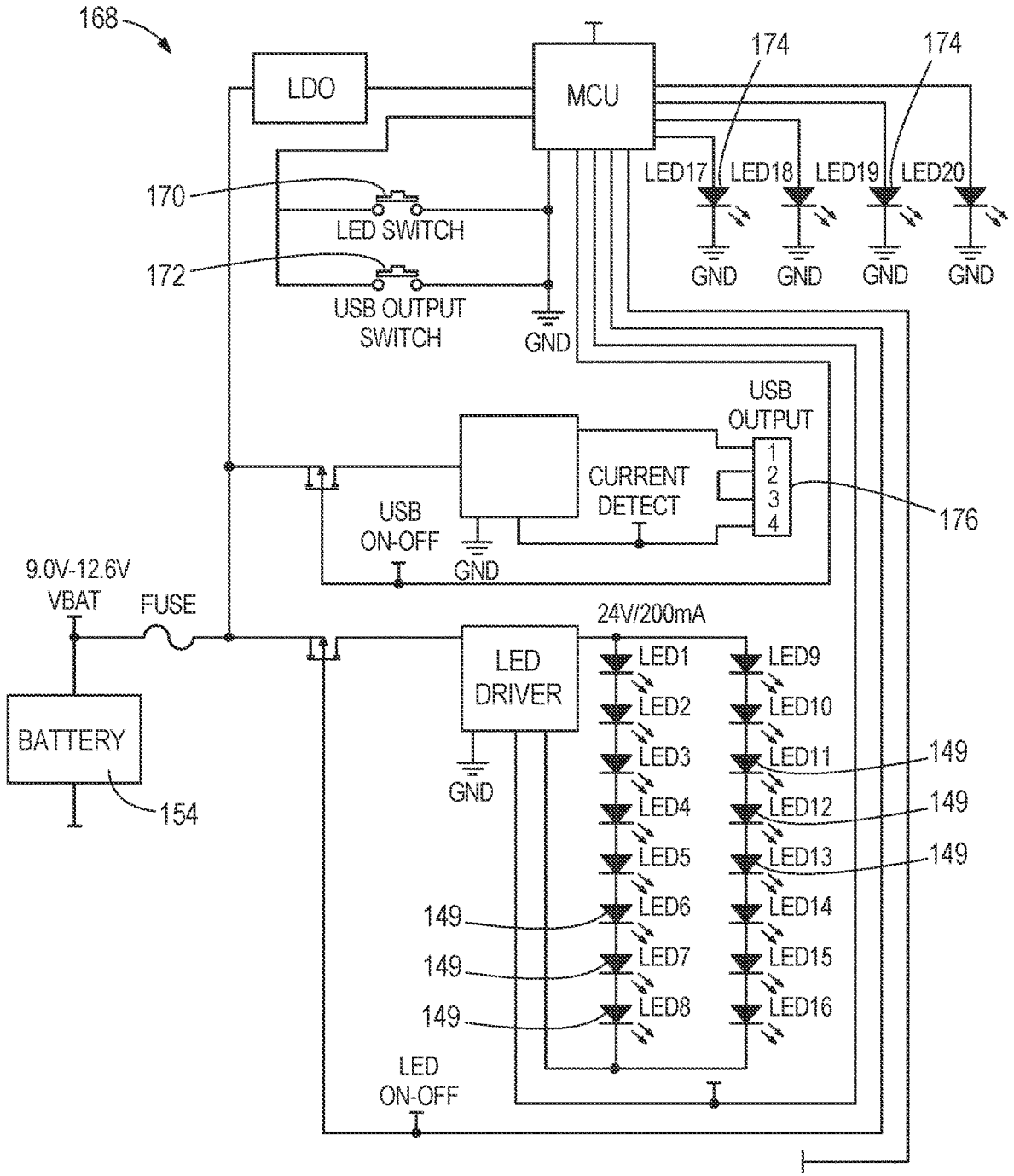
FIG. 9 is a circuit diagram of the work light of FIG. 1.

FIG. 9 illustrates an exemplary circuit diagram 168 for use with the work light 100. The circuit diagram 168 illustrates the layout of various electrical components of the work light 100, including the battery 106, a power switch 170 associated with the power button 112, a wake switch 172 associated with the wake button 114, lights 174 associated with the remaining battery power gauge light 116, a port power output (and/or input) 176 associated with the charging port 118, the LEDs 149, and the like. Of course, the illustrated circuit diagram 168 is only one example of the configuration of the electrical components of the work light 100, and other configurations are also contemplated herein.

Figure 10:
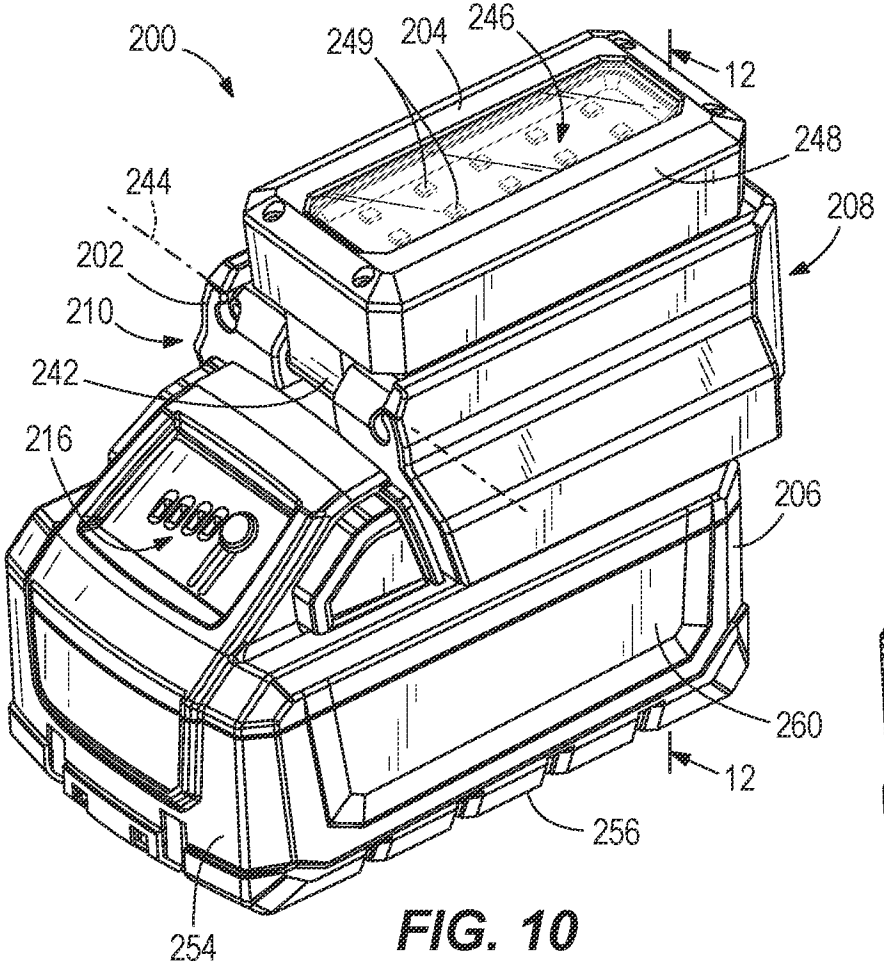
FIG. 10 is a top perspective view of a work light according to an embodiment of the disclosure.

FIG. 10 illustrates an alternative embodiment of a work light 200. Some components of the work light 200 of FIG. 10 are similar to components of the work light 100 of FIG. 1. As such, many of the similar components will be the same number, but increased by a value of one hundred. Some of the similar components may not be discussed further below for the sake of brevity.

Figure 15:
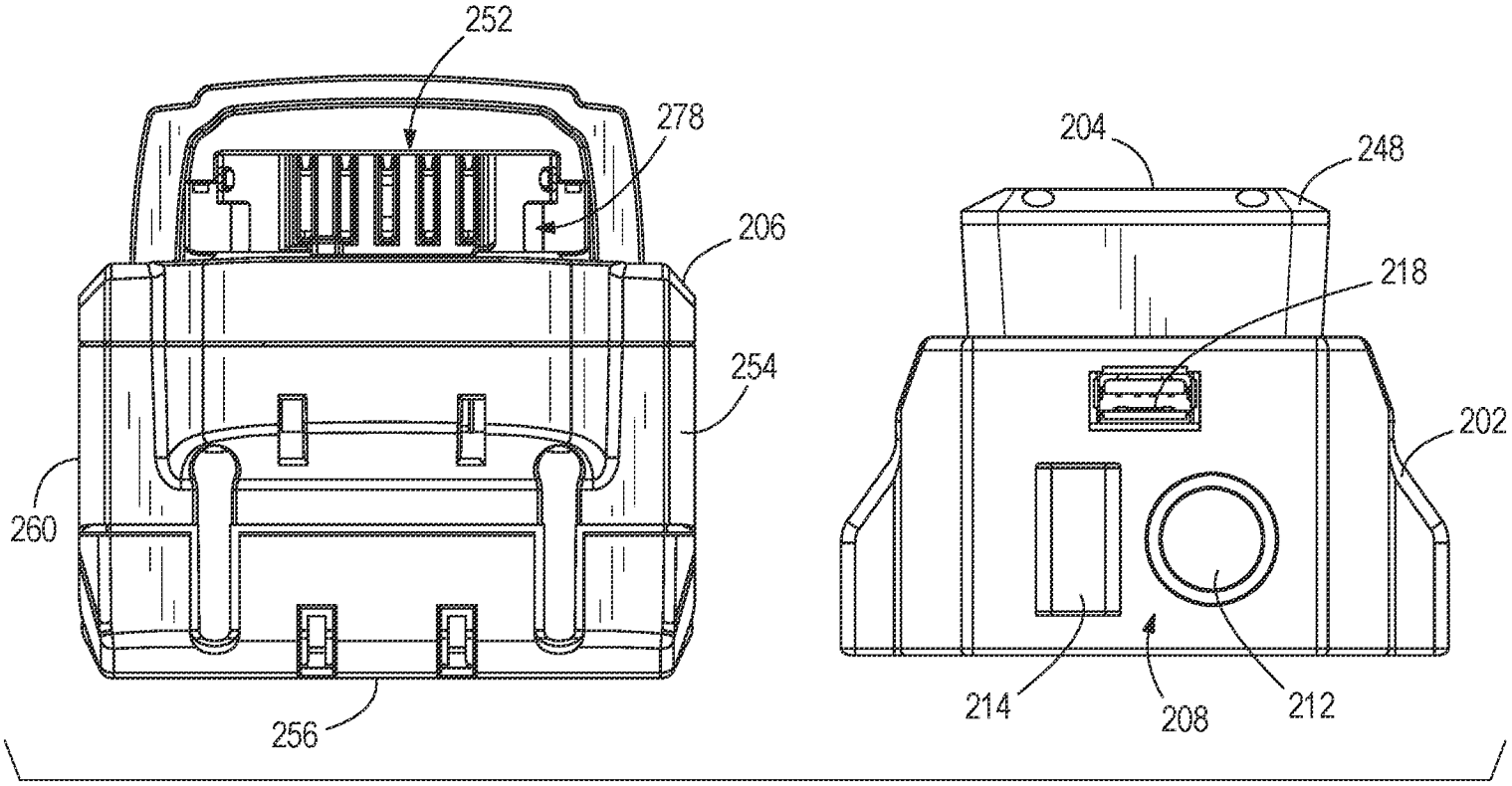
FIG. 15 is a rear elevation view of the work light of FIG. 10 with the battery removed from the body.

The work light 200 of FIG. 10 includes a body 202, a light source head 204, and a removable battery 206. The body 202 includes a first end 208 and a second end 220 opposite the first end 208. In the illustrated embodiment, the first end 208 includes one or more controls, such as a power button 212 and a wake button 214 disposed thereon. In some embodiments, at least one of the body 202 and the battery 206 includes one or more indicators, such as one or more battery power gauge lights 216. As shown in FIG. 15, the body 202 further includes a charging port 218 disposed on the first end 208 of the body 202.

Figure 13:
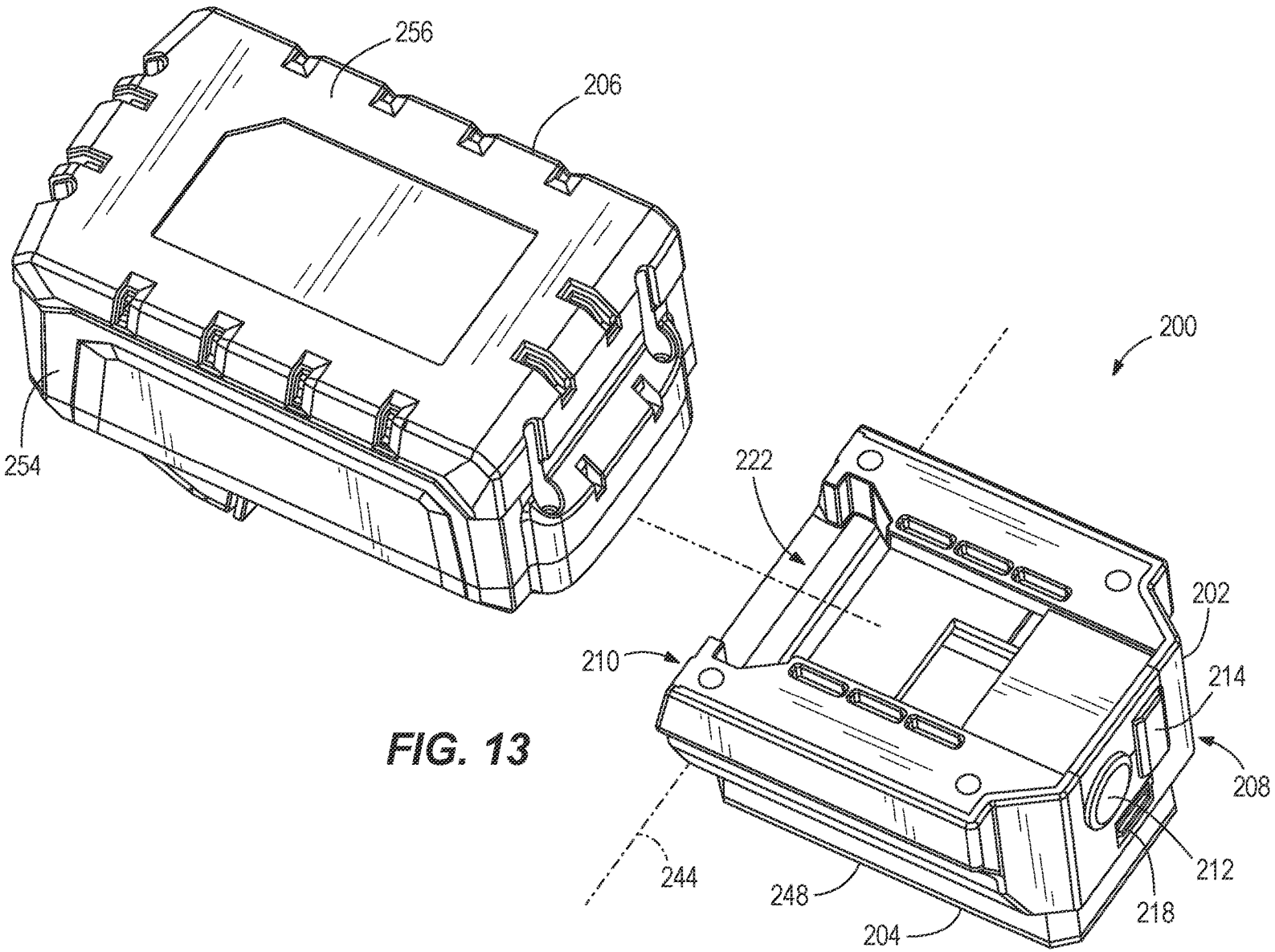
FIG. 13 is a bottom perspective view of the work light of FIG. 10 with the battery removed from the body.

Shown best in FIG. 13, the body 202 of the work light 200 further includes a battery receptacle 222 defined therein. In the illustrated embodiment, the battery receptacle 222 is disposed on a side of the body 202 that is opposite the light source head 204. Stated another way, the battery 206 couples to the body 202 on a side of the body 202 that is opposite the light source head 204. The battery receptacle 222 receives at least a portion of the battery 206 to power the work light 200. In the illustrated embodiment, the battery receptacle 222 is open on two sides of the body 202 such that the battery 206 is slidably received in the battery receptacle 222. In some embodiments, the battery receptacle 222 is oriented such that the battery 206 is slidably received in the battery receptacle 222 in a direction that is parallel with the length L5 of the body 202 (shown in FIG. 14). In some embodiments, at least one of the battery 206 and the body 202 includes one or more movable latching elements configured to secure the battery 206 to the body 202 when the battery 206 is fully inserted in the battery receptacle 222.

Figure 11:
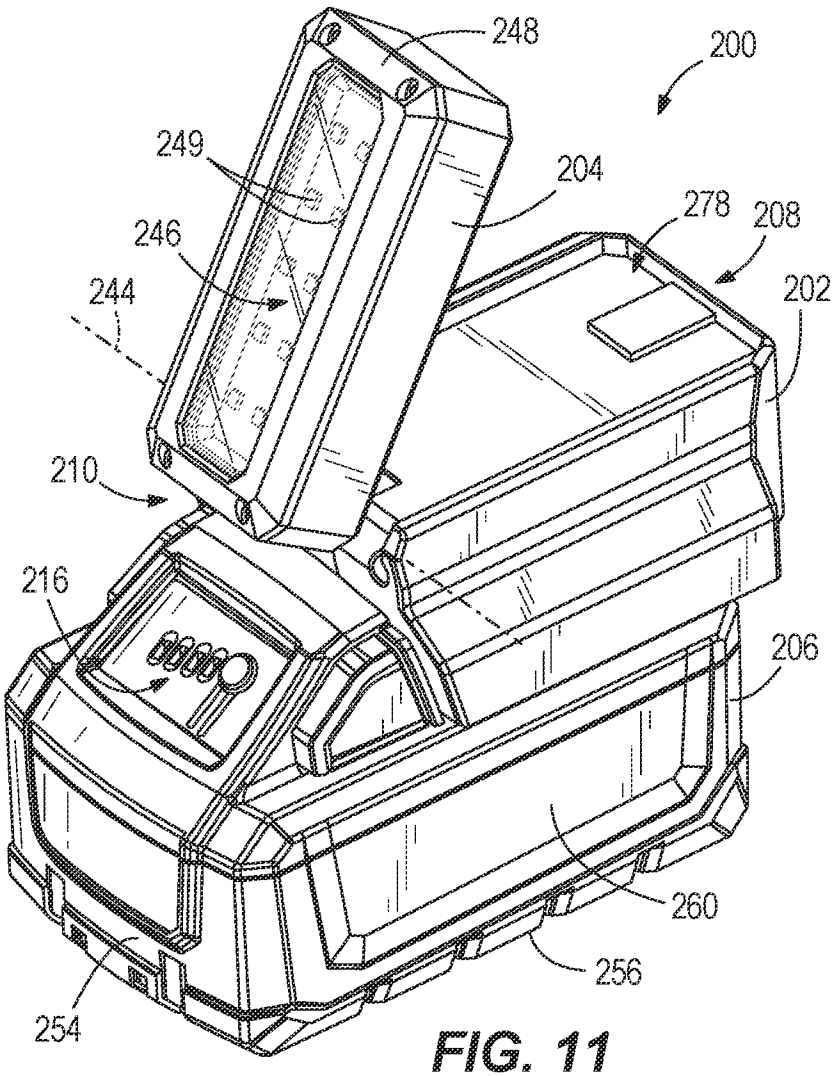
FIG. 11 is a top perspective view of the work light of FIG. 10 with a light source head pivoted away from the body.

With reference to FIGS. 10 and 11, the light source head 204 is pivotably connected to the body 202. In the illustrated embodiment, the light source head 204 is coupled to the body 202 by a single hinge 242. In some embodiments, the hinge 242 is disposed adjacent the second end 210 of the body 202. The light source head 204 is pivotable relative to the body 202 about a pivot axis 244. In the illustrated embodiment, the pivot axis 244 extends in a direction that is perpendicular to the length L5 of the body 202.

The light source head 204 includes a planar light panel 246 surrounded by a head frame 248. The light panel 246 includes a plurality of LEDs 249. The light panel 246 is selectively powered by the battery 206. The illustrated battery 206 is a power tool battery having a voltage of, for example, 18 volts.

Figure 12:
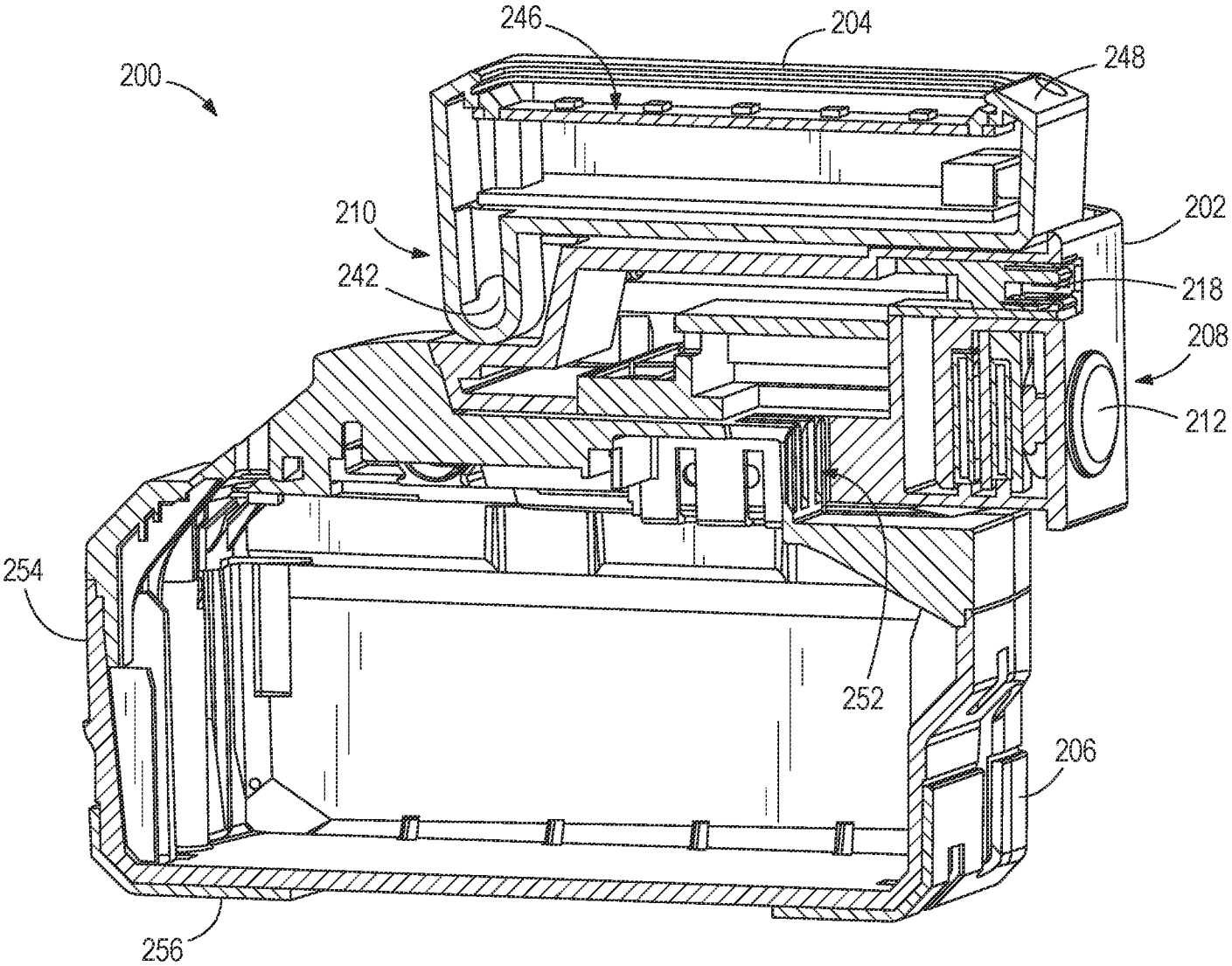
FIG. 12 is a perspective cross-sectional view of the work light of FIG. 10.
Figure 14:
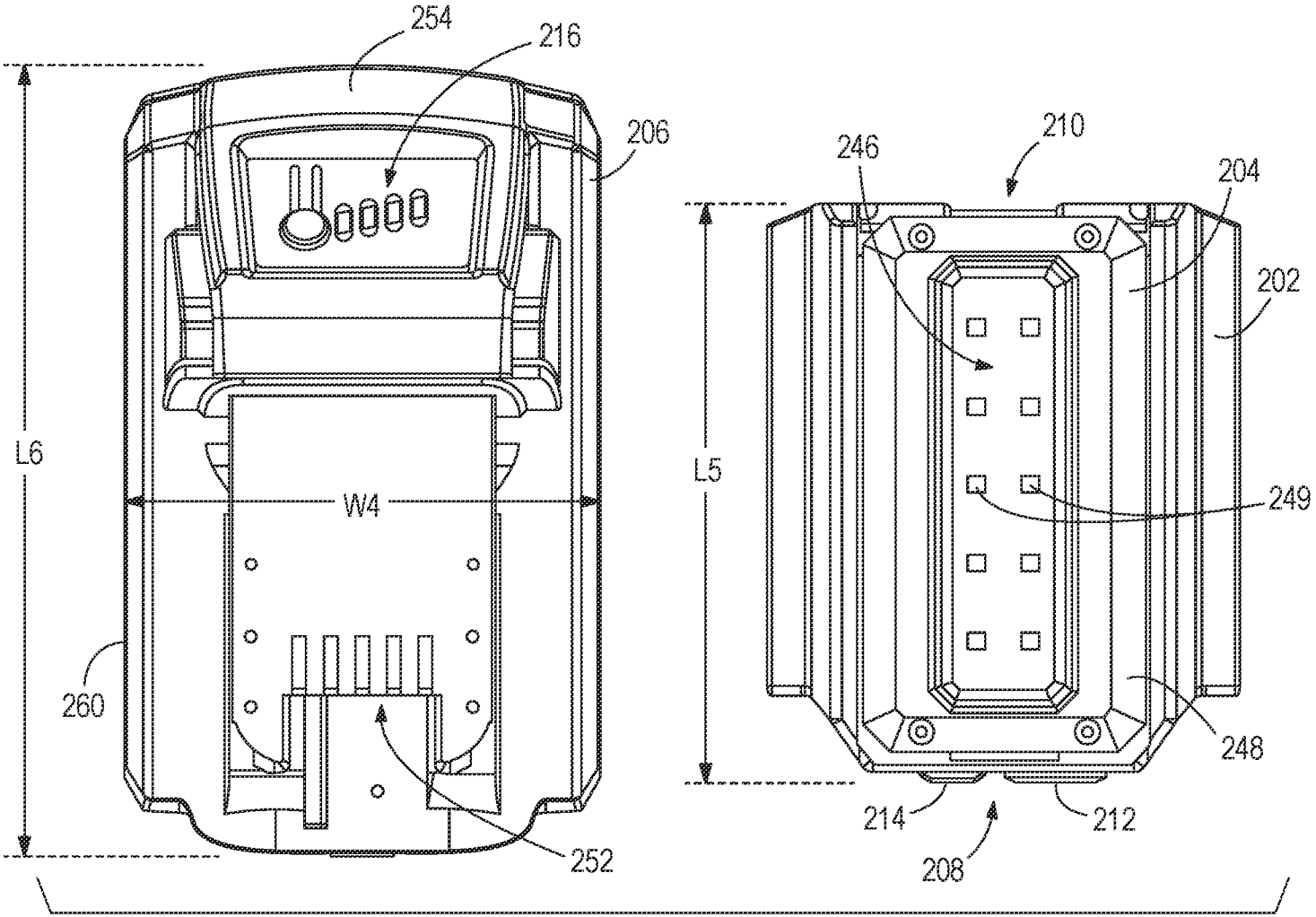
FIG. 14 is a top plan view of the work light of FIG. 10 with the battery removed from the body.

With reference to FIGS. 12 and 14, the battery 206 includes a connection portion 252 that is removably received within the battery receptacle 222 of the body 202. The battery 206 further includes an external portion 254 that is disposed outside of the body 202 even when the battery 206 is properly coupled to the body 202.

As shown in FIG. 13, the battery 206 further includes at least one support surface, such as a first support surface 256. The first support surface 256 is disposed on the external portion 254 of the battery 206. A user may adjust the light source head 204 relative to the body 202 to alter the direction of the light emitted from the light source head 204 at an angle relative to the first support surface 256 (angled relative to the floor and movable up and down relative to the floor, for instance).

Figure 16:
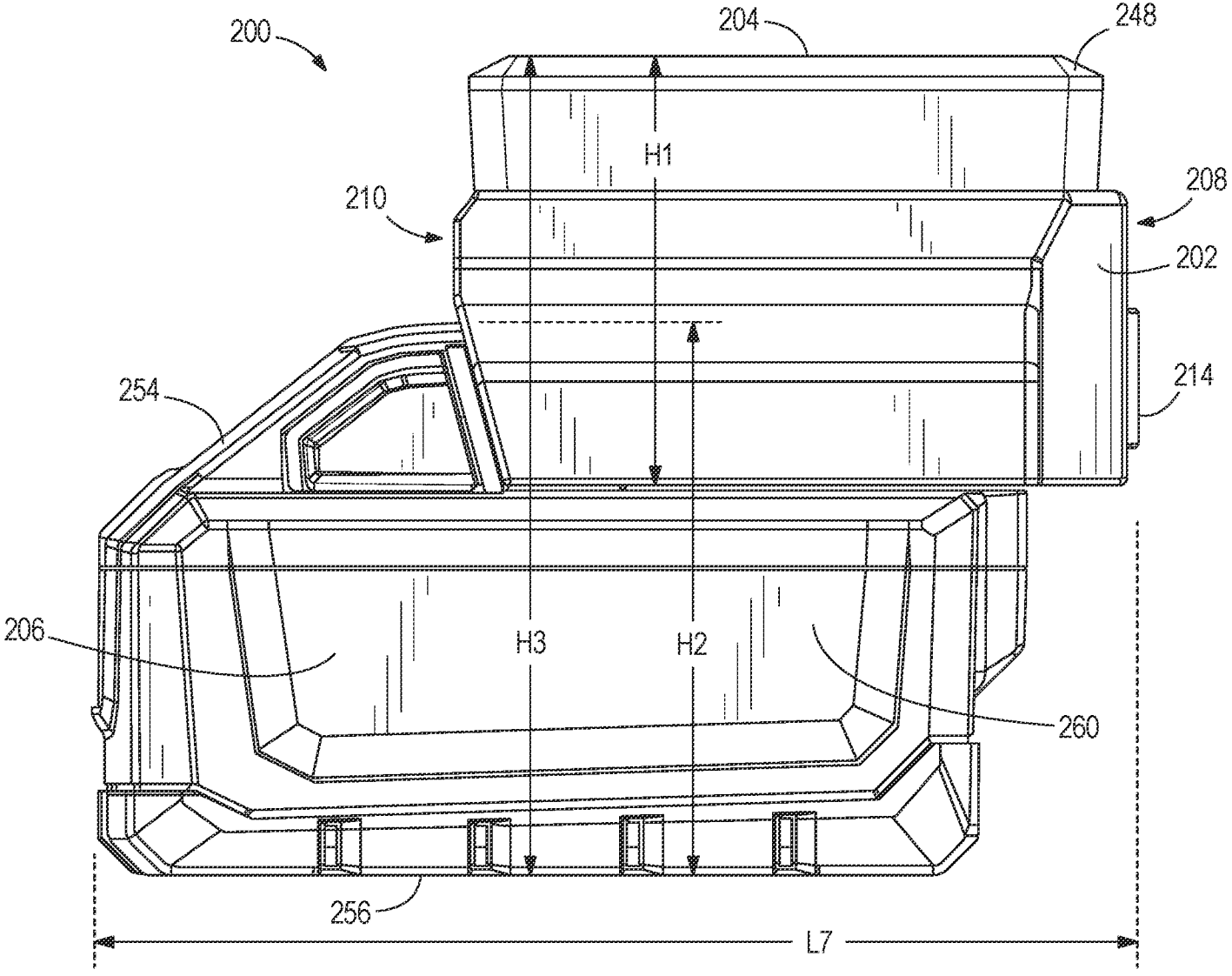
FIG. 16 is a side elevation view of the work light of FIG. 10.

As shown in FIG. 16, the battery 206 may also include at least one additional support surface, such as a second support surface 260. The second support surface 260 is illustrated as being perpendicular to the first support surface 256. This second support surface 260 allows the work light 200 to be oriented and maintained in a horizontal laying position on a work surface, such as the floor. While the work light 200 is in the horizontal laying position, a user may adjust the light source head 204 relative to the body 202 to alter the direction of the light emitted from the light source head 204 left or right relative to the work surface.

Referring particularly to FIG. 11, the body 202 includes a recess 278 defined therein. In the illustrated embodiment, the recess 278 is defined in the body 202 on a side of the body 202 that is opposite the battery receptacle 222. The light source head 204 is at least partially received within the recess 278 when the light source head 204 is positioned as shown in FIG. 10.

As shown in FIGS. 14 and 16, in some embodiments, the length L5 of the body 202 is less than the length L6 of the battery 206. For example, the length L5 of the body 202 may be between about 40% and about 90% of the length L6 of the battery 206. In some embodiments, the length L5 of the body 202 may be between about 50% and about 85% of the length L6 of the battery 206. In some embodiments, the height H1 of the body 202 and the light source head 204 is less than a height H2 of the battery 206. For example, the height H1 of the body 202 and the light source head 204 may be between about 40% and about 90% of the height H2 of the battery 206. In some embodiments the height H1 of the body 202 and the light source head 204 may be between about 60% and about 90% of the height H2 of the battery 206.

In some embodiments, the length L6 of the battery 206 is between about 3 inches and about 6 inches (between about 7.6 centimeters and about 15.2 centimeters), or between about 4 inches and about 5 inches (between about 10.2 centimeters and about 12.7 centimeters) in other embodiments. In some embodiments, the width W4 of the battery 206 is between about 2 inches and about 4 inches (between about 5.1 centimeters and about 10.2 centimeters), or between about 2.5 inches and about 3.5 inches (between about 6.4 centimeters and about 8.9 centimeters) in other embodiments. In some embodiments, the height H2 of the battery 206 is between about 1 inch and about 6 inches (between about 2.5 centimeters and about 15.2 centimeters), or between about 2 inches and about 4 inches (between about 5.1 centimeters and about 10.2 centimeters) in other embodiments.

With reference to FIG. 16, when the body 202 of the work light 200 is coupled to the battery 206, the body 202, light source head 204, and battery 206 define a total height H3 and a total length L7 of the work light 200. In the illustrated embodiment, the total height H3 is approximately double the height H1 of the body 202 and light source head 204. In addition, the total length L7 is between about 5% and about 25% greater than the length L6 of the battery 206. In some embodiments, the total length L7 may be equal to the length L6 of the battery 206. In still other embodiments, the length L6 of the battery 206 may be between about 85% and about 95% of the total length L7.

Although particular embodiments have been shown and described, other alternative embodiments will become apparent to those skilled in the art and are within the intended scope of the independent aspects of the disclosure. Various features of the disclosure are set forth in the claims.

The invention claimed is:

1. A work light comprising:

a body including a first end, a second end opposite the first end, and a mount surface between the first end and the second end for mounting the work light to a structure, the body having a first length measured from the first end to the second end;

a light source head pivotably connected to the body opposite the mount surface of the body, the light source head having a second length measured parallel to the first length; and a battery removably coupled to the second end of the body, the battery including a support surface disposed outside of the body, the support surface of the battery oriented perpendicular to the mount surface of the body, wherein the second length is longer than the first length such that the light source head extends past the second end of the body.

2. The work light of claim 1, wherein the light source head is pivotably connected to the body by a single hinge.

3. The work light of claim 1, wherein a portion of the battery is received inside the body.

4. The work light of claim 1, further comprising a power button disposed on the first end of the body opposite the battery.

5. The work light of claim 1, wherein the light source head includes a planar light panel, and the planar light panel is orientable perpendicular to the support surface of the battery.

6. The work light of claim 1, wherein the body includes a cross-sectional shape that is an isosceles triangle with rounded corners.

7. A work light comprising:

a body including a first end, a second end opposite the first end, the second end including a battery receptacle defined in the body, a first grip section disposed on one side of the body between the first end and the second end, a second grip section disposed on another side of the body between the first end and the second end, the second grip section opposite the first grip section, and a length measured from the first end to the second end;

a light source head coupled to the body by a hinge positioned on a side of the body, between the first end and the second end of the body, and between the first grip section and the second grip section, such that the light source head pivots relative to the body about a pivot axis that is parallel to the length, the light source head including a planar light panel; and a battery including a connection portion disposed in the battery receptacle of the body, and an external portion disposed outside of the body.

8. The work light of claim 7, further comprising a charging port coupled to the body adjacent the first end of the body, and a charging port cover pivotably connected to the body.

9. The work light of claim 7, wherein each of the first grip section and the second grip section includes an indentation defined in the body.

10. The work light of claim 7, wherein the body includes a continuous indentation defined therein, the continuous indentation extends about a majority of a perimeter of the body, and the first grip section and the second grip section are disposed in the continuous indentation.

11. The work light of claim 7, wherein the first grip section and the second grip section are spaced apart along a width dimension of the body, and the body is less than 10 centimeters wide.

12. The work light of claim 7, further comprising at least one control switch disposed on the body adjacent the first end.

* * * * *